US005884436A

United States Patent [19]

Ebbitt

[11] Patent Number: 5,884,436

[45] Date of Patent: Mar. 23, 1999

[54] REVERBERATION ROOM FOR ACOUSTICAL TESTING

[75] Inventor: Gordon L. Ebbitt, Ann Arbor, Mich.

[73] Assignee: Lear Corporation, Southfield, Mich.

[21] Appl. No.: 437,866

[22] Filed: May 9, 1995

[51] Int. Cl.[6] ..... E04B 1/99

[52] U.S. Cl. ..... 52/79.4; 52/144; 181/30; 181/295

[58] Field of Search ..... 52/79.4, 36.1, 52/144; 181/30, 295

[56] References Cited

U.S. PATENT DOCUMENTS

| | | | |
|---|---|---|---|
| 1,881,146 | 10/1932 | Sugar | 181/30 |
| 3,144,513 | 8/1964 | Sherron | 52/144 X |
| 3,517,468 | 6/1970 | Woods | 52/144 X |
| 4,366,882 | 1/1983 | Parker | 181/30 |
| 4,605,093 | 8/1986 | Karlen | 181/295 |
| 5,631,661 | 5/1997 | Sanchez | 343/703 |

FOREIGN PATENT DOCUMENTS

| | | | |
|---|---|---|---|
| 694374 | 9/1965 | Italy | 181/30 |

OTHER PUBLICATIONS

Ebbitt, G., et al., *Computer Optimized Design of a Reverberation Room*, Noise–Con 94, Ft. Lauderdale, Florida, May 01–04, 1994, pp. 857–859, 861–862.

Geddes, E.R., *An Analysis of the Low Frequency Sound Field in Non–Rectangular Enclosures Using the Finite Element Method*, Doctoral Thesis, Pennsylvania State University, 1982.

Louden, M.M., *Dimension–Ratios of Rectangular Rooms with Good Distribution of Eigentones*, Acustica, vol. 24, pp. 101–104, 1971.

Milner, J.R., *Acoustic Shape Optimization*, Doctoral Thesis, Purdue University, 1987.

Milner, J.R., *An Investigation of the Modal Characteristics of Nonrectangular Reverberation Rooms,* J. Acoust. Soc. Am., 35(2), pp. 772–779, Feb. 1989.

van Nieuwland, J.M., et al., *Eigenmodes in Nonrectangular Reverberation Rooms,* Noise Control Engineering, 13(3), pp. 112–121, Nov.–Dec., 1979.

Sepmeyer, L.W., *Computed Frequency and Angular Distribution of the Normal Modes of Vibration in Rectangular Rooms,* J. Acoust. Soc. Am., 37(3), pp. 413–423, Mar. 1965.

*Primary Examiner*—Carl D. Friedman
*Assistant Examiner*—Laura A. Callo
*Attorney, Agent, or Firm*—Wood, Herron & Evans, L.L.P.

[57] ABSTRACT

A reverberation room comprising walls, ceiling and floor having specific dimensions and spatial relationships used in an automotive testing laboratory to analyze sound for the purposes of measuring transmission loss and sound absorption. The room possesses two transmission loss test windows. One window is placed in the ceiling and one is placed in a side wall. Samples for testing can be mounted horizontally in the ceiling window. A rotating microphone boom is used in combination with the room to sample the sound field in the reverbration room and in reception chambers attached thereto. Three loudspeakers are also positioned in the room to generate the sound field in the reverberation room and indirectly in the reception chambers.

19 Claims, 5 Drawing Sheets

REVERBERATION ROOM FOR ACOUSTICAL TESTING

FIELD OF THE INVENTION

The present invention relates to a reverberation room that has improvements over typical designs found in present reverberation rooms used for testing of sound. These improvements include the shape of the room, the placement of the loudspeakers used for excitation, and the location of the windows for transmission loss measurements.

DESCRIPTION OF THE PRIOR ART

A reverberation room in an automotive materials testing laboratory is used in sound testing for two main purposes. First it is used to measure transmission loss via the SAE J1400 standard. Second, it is used to measure absorption using the test procedures found in ASTM4 C423 and ISO 354. It can also be used to measure sound power according to test procedures ANSI S12.31 and ANSI S12.32.

The volume of the reverberation room is significant because the room should be large enough to give good low frequency diffuision, and yet at the same time it should not be so large that there will be an unacceptable amount of air absorption at high frequencies. The ASTM and ISO testing procedures noted above recommend that the volume be close to 200 $m^3$.

The prior art contains disclosures covering both rectangular and non-rectangular reverberation rooms. In general, reverberation rooms are constructed using rectangular designs. These designs are preferred because there are closed form analytical equations describing the sound pressure distribution and the modal distribution in rectangular rooms.

Being able to describe the sound field in the room is important since there are many room shapes that provide poor performance. When a theoretical two dimensional rectangular room has dimensions that are integral multiples of each other, there will be a concentration of room modes at certain frequencies. At those frequencies the sound field in the room will become less diffuse. This will cause an increase in the variability of the sound pressure in the room and it will result in an increase in measurement error. The increase in measurement error is due to the fact that all measurements are based on the assumption that the sound field in the room is diffuse.

Previous designs have generally been based on rectangular designs since the sound field that will be set up in the room can be accurately predetermined before construction is begun.

Prior art references relating to rectangular reverberation rooms are: M. M. Louden, *Dimension-ratios of Rectangular Rooms with Good Distribution of Eigentones*, Acustica (24), 1971; L. W. Sepmeyer, *Computed Frequency and Angular Distribution of the Normal Modes of Vibration in Rectangular Rooms*, J. Acoust. Soc. Am., Vol. 37, No. 3, pp 413–423, 1965.

The frequency spacing between the eigenmodes (the modal distribution) has often been used to evaluate the quality of a reverberation room. If the room modes are clustered in the neighborhood of a particular frequency, the distribution of the sound pressure will generally be especially irregular near that frequency. This is a significant problem at low frequencies where modal density is falling off. It is therefore desired that the modal spacing be as uniform as possible to as low a frequency as possible.

In order to find an optimum rectangular room, Louden and Sepmeyer examined modal spacing for a substantial number of rectangular rooms. Sepmeyer also examined the angular distribution of modes.

Rectangular rooms provide the benefit of providing an analytical solution for their modal distribution, however they are not unequivocally the optimum shape for a reverberation room. All rectangular rooms have axial modes. The axial modes between two parallel walls are affected by any changes on the surface of either of those walls, while other axial modes are not affected. Thus, changes to the amount of absorption to one wall will substantially affect some of the modes in the room, while leaving the others unchanged. This reduces the diffuseness of the sound field and may cause the reverberation decay which occurs to be nonlinear. In a room where there are no parallel surfaces, there is no axial mode or tangential mode. In such a case, a change to any surface in the room will influence every mode.

With respect to nonrectangular rooms, it is more difficult to obtain an optimum design. There are no closed form analytical solutions to calculate the room modes. In such a room, there are many shapes that have modal spacings that are less than optimum and are in fact worse than would be obtained from an optimum rectangular room.

A nonrectangular acoustical testing room is disclosed in a doctoral thesis by Joseph R. Milner in an article entitled: *Acoustic Shape Optimization*, Doctoral Thesis, Purdue University, August 1987. The aforementioned article contains a study of two dimensional rooms to determine the room shape with the optimal modal spacing. Because the study concentrated on two dimensional shapes it was, therefore, not practical. The optimal shape in the article also calls for a room in which none of the corners are 90°. One of the corners in the present invention is 90°.

Other prior art references relating to nonrectangular reverberation rooms are: Earl Russell Geddes, *An Analysis of the Low Frequency Sound Field in Nonrectangular Enclosures Using the Finite Element Method*, Doctoral Thesis, Pennsylvania State University, 1982; J. M. van Nieuwland and C, Weber, *Eigenmodes and Nonrectangular Reverberation Rooms*, Noise Control Engineering, Nov.–Dec., 1979.

In both rectangular and nonrectangular rooms, small changes in the shape of a nonrectangular room has a big influence on the modal distribution.

The prior art leads to the conclusion that changes of as little as 1% in room dimensions are significant. Accordingly, this poses a problem in the practical construction of a room when less than 1% tolerance is desired.

The requirements for the SAE J1400 transmission loss test can be met using a conventional reverberation room design. A desire to increase low frequency performance for a given room volume and a need to provide for two transmission loss fixtures led to the design of the room comprising the present invention. For example, when the transmission loss of automotive barrier materials are measured, the samples are often placed next to a piece of sheet metal. This is done to simulate their use in the vehicle. A problem arises for those materials that are installed horizontally in the vehicle. In the typical carpet system in a vehicle comprising a carpet plus barrier plus underpad, there is a double walled system with the underpad serving as a decoupler between the sheet metal floor and the barrier layer. If this sample is tested in a vertical position, there is invariably an unintentional air gap between the sheet metal and the decoupler. This arrangement gives misleadingly inflated transmission loss readings since the air gap does not exist when the material is used horizontally in the vehicle.

More specifically, the solution to this problem according to the present invention is to provide two openings in the reverberation test room for transmission loss tests, that is a vertical opening in a side wall of the room and a horizontal opening in the ceiling of the room. This places an additional requirement on the reverberation room. The sound intensity incident on the two openings noted above must be the same. If there are differences in the intensity, this will lead to different measurement results. Thus it is not sufficient to have a reverberation room design that has been optimized for modal spacing. The actual distribution of energy in the room must be examined to insure that there will be the same intensity incident on the two windows.

SUMMARY OF THE INVENTION

The reverberation room of the present invention is a nonrectangular reverberation room which thus has non-parallel side walls. One corner of the room is formed by the intersection of walls that form an angle of 90 degrees which provides compactness and ease of construction. The advantage of using such a shape is that there are no axial modes between the side walls in such a room.

Axial modes are found wherever there are parallel surfaces. Axial modes can be more of a problem than tangential or oblique modes. This is because a change to the absorption on one wall will greatly affect all axial modes between that wall and the one parallel to it. The influence on all other room modes will be much less significant.

The room possesses two transmission loss test windows. One window is placed in the ceiling and one is placed in a side wall. Samples for testing can be mounted horizontally in the roof top window.

A rotating microphone boom is used in combination with the room to sample the sound field in the reverberation room and in the reception chambers which are attached thereto.

Three loudspeakers are also positioned in the room to generate the sound field in the reverberation room and indirectly in the reception chambers.

DETAILED DESCRIPTION OF THE PREFERRED EMBODIMENTS OF THE INVENTION

Figure 1:
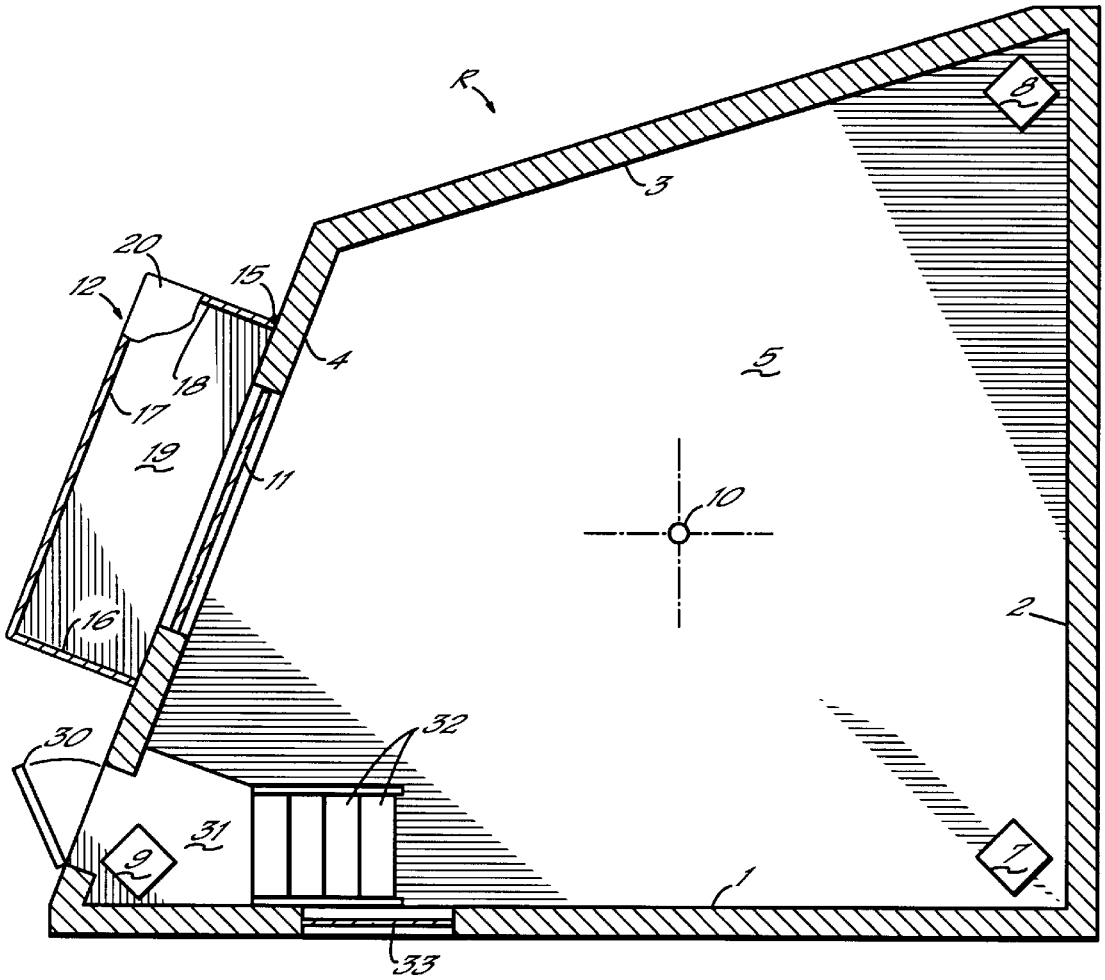
FIG. 1 is a plan view of the room with the reception chamber adjacent thereto.
Figure 2:
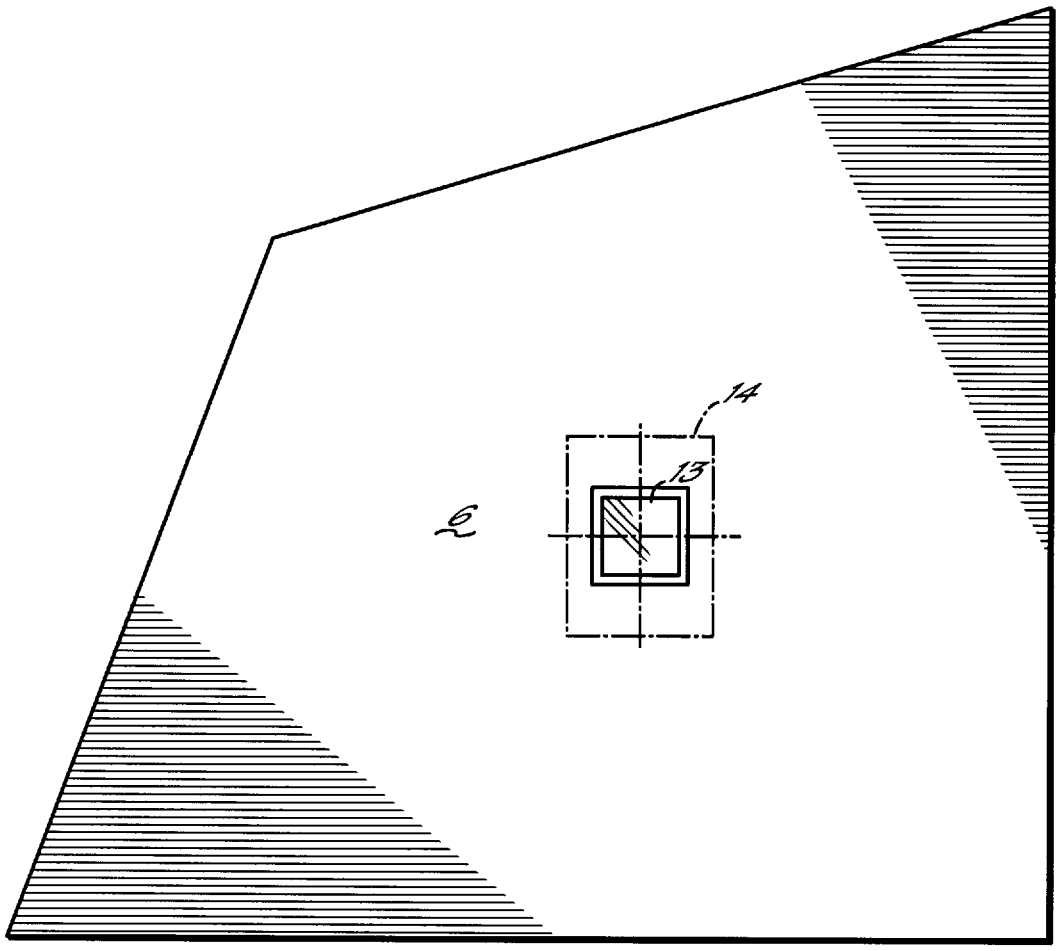
FIG. 2 is a plan view of the top of the room with the top reception chamber depicted.

Referring to FIG. 1, reverberation room R is the volume defined by the interior of side walls 1, 2, 3 and 4, and floor 5 and top or ceiling 6. To eliminate any confusion, the interior of element 6 of room R is the ceiling and the exterior is referred to as the top. The angle defined by the intersection of walls 1 and 2 is 90°. At the intersection of walls 1 and 2 and positioned substantially on floor 5 is speaker 7.

The angle defined by the intersection of walls 2 and 3 is an acute angle which is preferably about 73°45'. At the intersection of walls 2 and 3 and positioned substantially on floor 5 is speaker 8.

The angle defined by the intersection of walls 1 and 4 is an acute angle which is preferably about 70°25'. At the intersection of walls 1 and 4 and positioned on the wall adjacent ceiling 6 is speaker 9. Speaker 9 is positioned as close to ceiling 6 as possible.

Further, the optimal placement of loudspeakers in the room was determined analytically to be at the locations at the intersection of the walls as set forth above.

Microphone 10 is fixed to a boom or any convenient or suitable supporting means which are positioned in the central area of floor 5. The location of the microphone is desirably in the center of the room with it being set up at least one meter from an adjacent wall.

In wall 4, which subtends the 90° angle formed by walls 1 and 2, there is an opening therethrough which formns window 11. Window 11 is a clear opening preferably measuring about 5 feet by 8 feet that provides an unencumbered path between room R and chamber 12 position immediately adjacent window 11.

Figure 3:
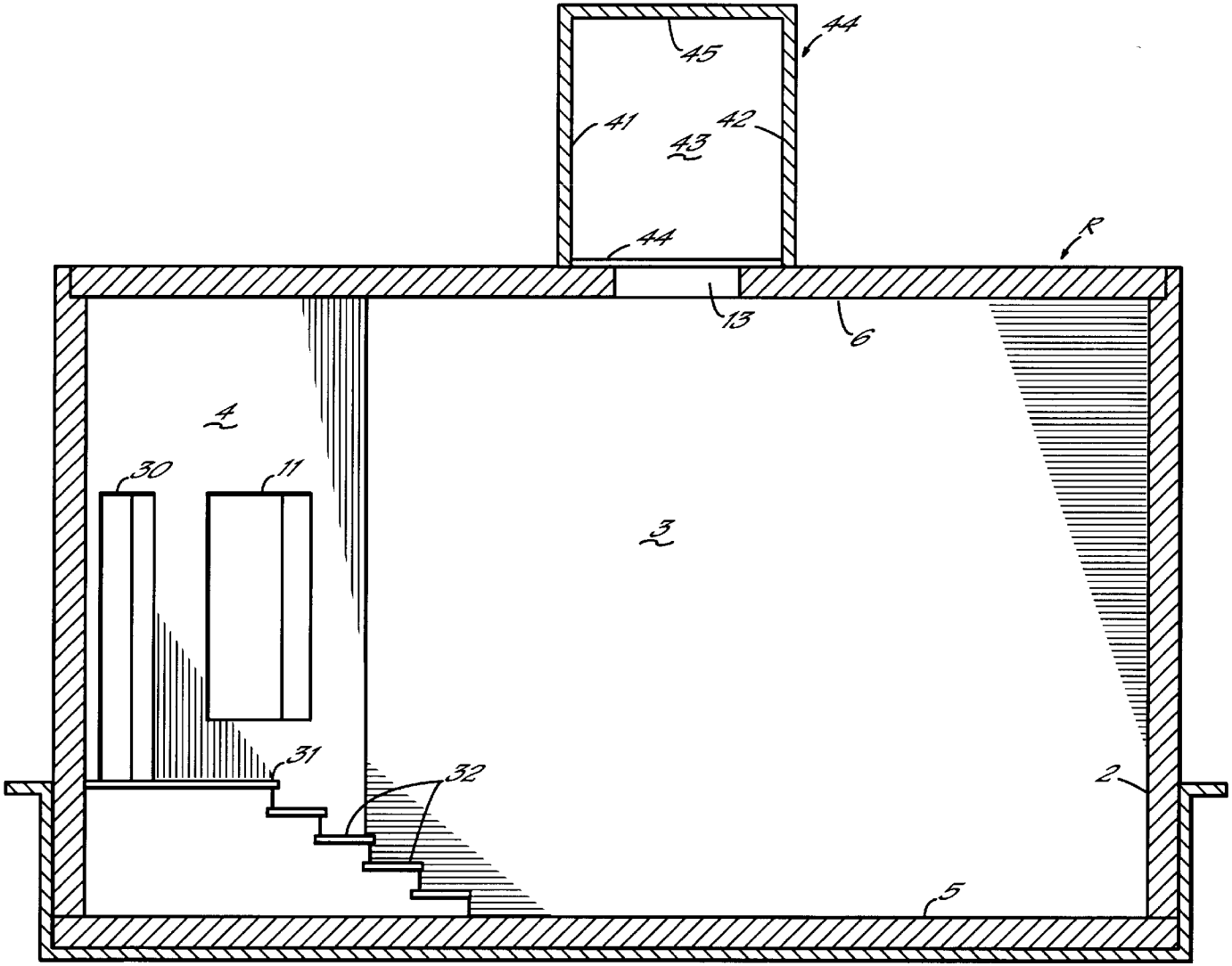
FIG. 3 is a side view of the room.

In addition, as shown in the top view depicted in FIG. 1 and the side view depicted in FIG. 3 through wall 4 there is a door 30 which allows personnel to gain access into the room when needed. When the room is constructed below grade, the presence of platform 31 and set of stairs 32 connecting ground level to floor 5 is convenient. Further, wall 1 contains observation window 33 therethrough.

The foundation of the reverberation room of the present invention is preferably positioned below ground level and is independent of the foundation of the building in which it is situated. When floor 5 of room R is below ground level, window 11 is at a convenient height to mount samples for testing from outside room R.

To preclude extraneous vibrations that during testing would compromise the accuracy of the testing, the foundation forming floor 5 comprises poured concrete having a thickness of at least nine inches on a rigid foam layer having a thickness of at least four inches over at least six inches of compacted sand. For example, the floor comprising the composite as set forth above provides mechanical isolation so that a dynamometer that might be utilized concurrent with the sound testing in the room would not provide vibrations that would register as noise in the results obtained from the reverberation room testing.

Aside from transmission loss test windows 11 and 13, door 30 and observation window 33, the interior surfaces of walls 1, 2, 3, 4, floor 5 and ceiling 6 must be sealed so that as much as possible, they possess a smooth continuous surface which is substantially impermeable to noise.

For this reason, the exterior of walls 1, 2, 3, 4 constructed preferably of concrete block filled with mortar. The interior of each of the walls is finished by the application of plaster to lath which has been secured to the concrete walls. The interior walls are finished with alkyd resin or epoxy paint to provide a hard non-porous surface.

This construction is preferred, however, in general, any construction that provides massive rigid walls, ceiling, and floor is acceptable. Note that it is important that the interior finish must provide a minimal amount of acoustic absorption.

The height of room R has been set so that the overall volume of the room is 200 $m^3$.

In top 6, there is an opening therethrough which forms a second transmission loss window 13. Window 13 is also a clear opening preferably measuring about 3 feet by 3 feet that provides an unencumbered path between room R and chamber 14 position immediately adjacent window 13.

Figure 4:
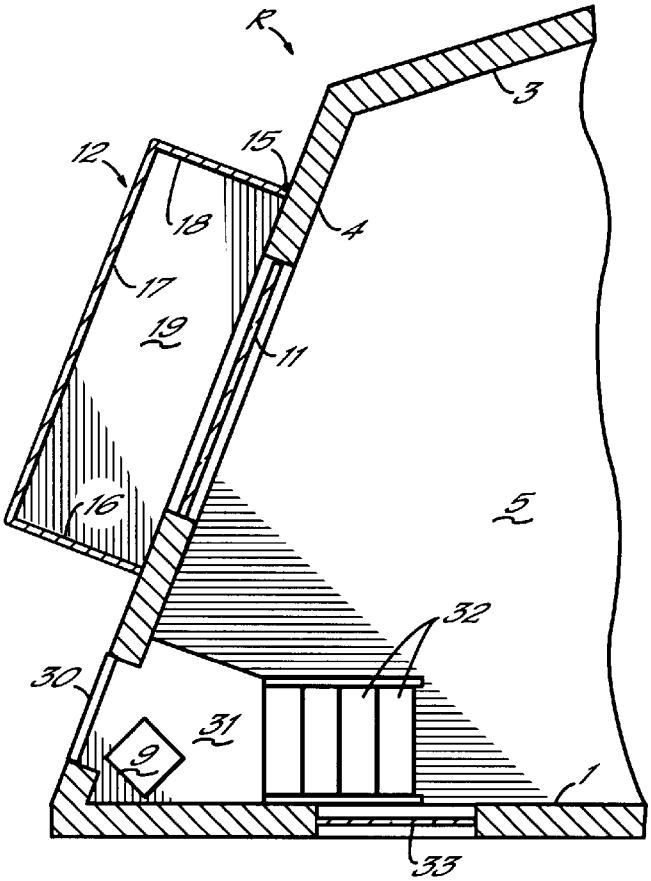
FIG. 4 is a detailed plan view of the side reception anechoic chamber.

FIG. 4 is a plan view of chamber 12 positioned adjacent wall 4 and rotatably secured to the exterior of wall 4 by means of pivot 15. Chamber 12 is an anechoic chamber designed so that the interior thereof is free from echoes and reverberation. Chamber 12 can be rotated to provide access to the transmission loss opening. The chamber comprises walls 16, 17 and 18, floor 19 and ceiling 20. Within chamber 12, the walls, floor and ceiling are lined with anechoic wedges 25 (not shown, see FIG. 6) which along interior wall 17 are about 3 feet deep whereas the wedges lining walls 16 and 18, floor 19 and ceiling 20 are about one foot in depth. Wedges 25 (not shown) along wall 17, diametrically opposite transmission loss window 11, are three feet in depth to absorb the low frequencies if any during the test.

Figure 5:
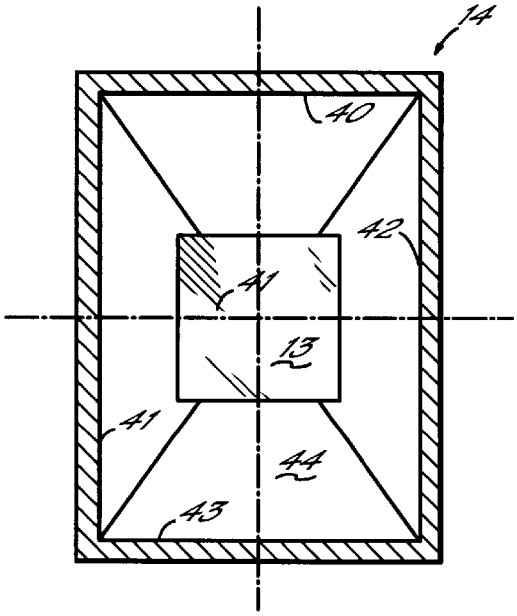
FIG. 5 is a detailed plan view of the top anechoic reception chamber.

FIG. 5 Chamber 14 is an anechoic chamber designed so that the interior thereof is also free from echoes and reverberation. The chamber comprises walls 40, 41, 42 and 43, floor 44 and ceiling 45. Within chamber 14, the walls, floor and ceiling are lined with anechoic wedges 25 (not shown, see FIG. 6) which along ceiling 45 are about 3 feet deep whereas the wedges lining walls 40, 41, 42 and 43, floor 44 are about one foot in depth. Wedges 25 (not shown) along ceiling 45, diametrically opposite transmission loss window 13, are three feet in depth to absorb the low frequencies if any during the test.

Figure 6:
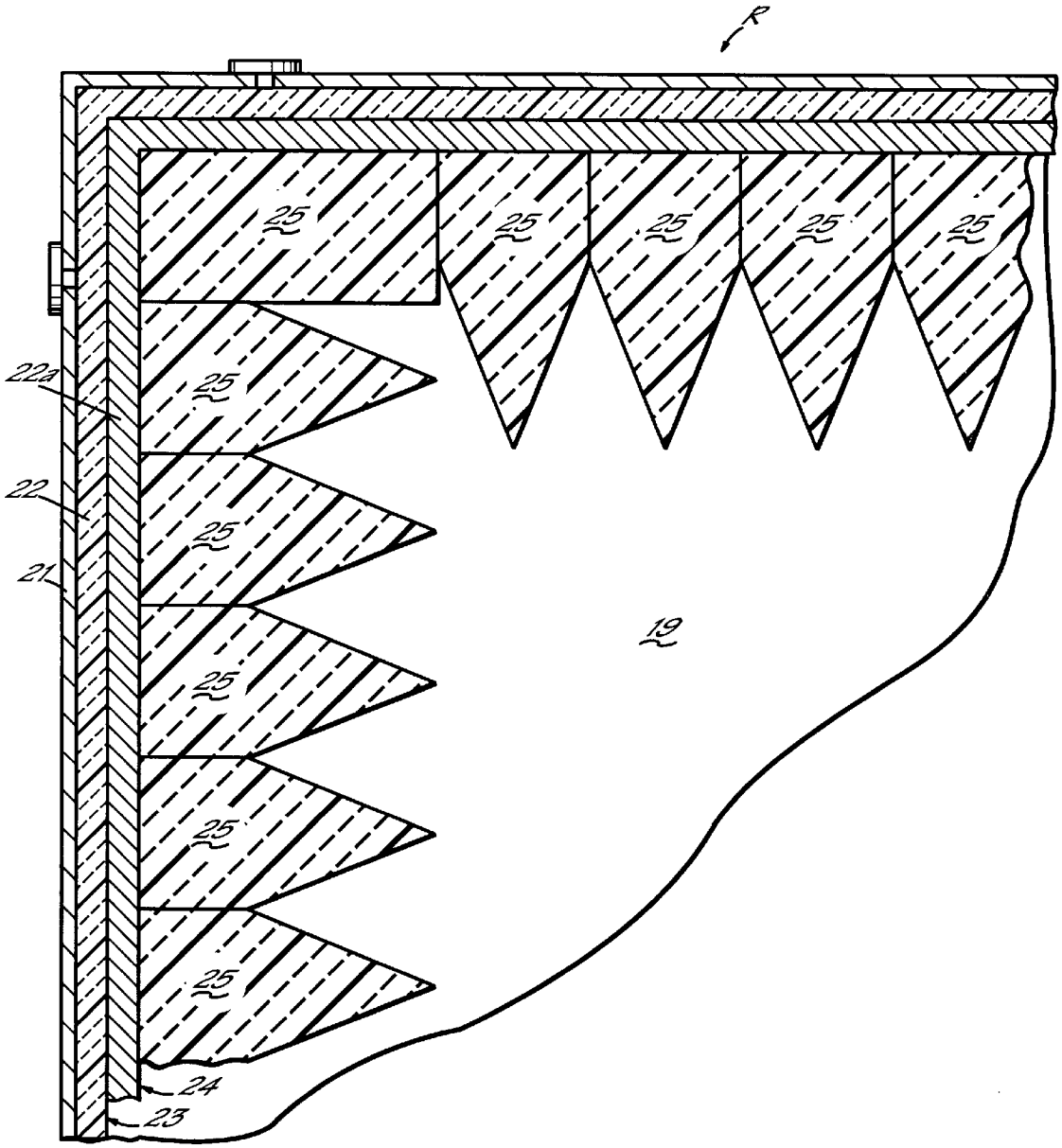
FIG. 6 is a cross sectional view of the walls that comprise the reception chamber.

FIG. 6 is a cross sectional view of the walls of the chambers of the present invention. The walls, floor and ceiling of chambers 12 and 14 are all formed of the laminate structure depicted. Exterior wall 21 is typical building facade material. Layers 22 and 22A are composed of about one inch resilient foam, such as polyurethane. Sandwiched between foam layers 22 and 22A is a layer of resinous material 23, preferably poly(vinylchloride). The poly (vinylchloride) used in the layer has a density of about 1 pound per square foot. Layer 24 adjacent foam layer 22A is a sheet of steel of approximately 20 gauge. Layer 25 is composed of anechoic wedges which ideally are flexible, open cell polyurethane foam, however any foam or material that will absorb 99% of incident energy in the chamber can be used. Wedges 25 in FIG. 6 are missing in FIGS. 4 and 5 as detailed above.

Additional modeling was required to determine whether the three dimensional room would retain the desirable sound pressure distribution found in the two dimensional model and whether the small change in the one corner would produce a major affect on the sound field. Boundary element computer models confirm that the sound field distribution in this room is very good.

The reverberation room of the present invention uses the two transmission loss windows for sound transmission loss measurements as per SAE J1400. Roof top opening 13 is very useful when testing materials that are commonly found in a horizontal orientation, for example in an automobile. For instance, carpet can be tested in this manner. When the carpet is placed next to a sheet of steel (as is normal in automotive testing), gravity will insure that there is no air gap between the test specimen and the steel sheet. When samples are tested vertically (as is common practice), there can easily be an air gap between the sample and the sheet steel.

The room of the present invention can be conveniently used to test transmission loss, to run sound absorption tests or to run sound power tests.

The transmission loss tests are conducted pursuant to SAE J1400. The SAE standard specifies that a two room suite be used,. The source room, i.e. the room that contains the loudspeakers) shall be reverberant. The receiving room, i.e. the reception chamber, shall be anechoic. Theses conditions are met in the room of the present invention. Before any tests are run, a limp massive sample (lead for example) is mounted in the window between the two rooms. In the present invention these windows are either 11 or 13 in FIG. 1. A noise is produced in the source room and the sound pressure level in both the source and receiver rooms is measured. The difference in sound pressure in the two rooms is then calculated. The difference is known as the measured noise reduction The transmission loss of the limp reference material is calculated based upon the mass law. This is a theoretical calculation that utilizes the mass of the limp sample. The difference between the calculated transmission loss and the measured noise reduction provides a value known as the correlation factor. The correlation factor is used in subsequent measurements to calculate an unknown material's transmission loss.

In accordance with the present invention, a flat sample of material is mounted on window 11. The sample was placed next to a 20 g. steel sample to simulate its use as such parts in a vehicle as carpet, dash insulators, etc. A noise source is then generated via the speakers in the source room and the difference in the sound pressures in the source room and the reception chamber was measured. The transmission loss was then calculated based upon the aforementioned difference minus the correlation factor.

A second test measuring transmission loss was run using window 13. The transmission loss was calculated by determining the difference as detailed above and subtracting the correlation factor therefrom.

Sound absorption tests were also conducted following the procedures detailed in ASTM C423. The windows 11 and 13, was blocked with a rigid sound reflective material so that they possessed, as nearly as possible, the same reflective characteristics as the other walls of the reverberation room. The reverberation time of the empty room was then measured. This was done by generating noise from the three loudspeakers for a given period and then abruptly terminating the noise by breaking the electrical connection between the amplifiers and the loud speakers, or alternatively, between the noise generators and the amplifiers. The sound level in the room was then monitored by analysis equipment and the length of time taken for the sound to decay by 60 dB was noted. In general the time for a 60 dB decay will be extrapolated based upon the values obtained from the test.

Once the empty room reverberation time was determined, a sample was placed in the room. The samples in each test run were either flat covering a substantial portion of the floor of the room (72 square feet area is preferred according to the ASTM standard) or they were single parts such as, a headliner or carpet assembly. The reverberation time of the room with the sample in place was then measured. Since there was an absorptive sample in the room, the reverberation decay time will be shorter than the empty room reverberation time. The difference between the empty room reverberation time of the reverberation time of the room with the sample in place is used to determine the amount of absorption possessed by the sample. If the area of the sample is measured, then the absorption coefficient can be calculated.

Sound power tests were performed using the room of the present invention pursuant to ANSI S12.31 and S12.32. The two standards are nearly identical. The differences between them relate to the quality of the diffuseness of the sound field in the reverberation room.

For these tests a reference sound source, whose sound output power is known, was placed in the room and turned on. The average sound pressure in the room was then measured. The difference between the measured sound pressure and the known sound power of the reference sound was noted. The resulting value was used as a correction factor for subsequent measurements of unknown sound sources.

For the actual measurements, the reference source was removed and an unknown source was placed in substantially the same position as was the reference source. The average sound pressure in the room generated by the unknown source was noted and the sound power of the unknown source is calculated based upon the sound pressure and the correction factor.

The sound power of an unknown source can also be measured by what is known as the direct method. In this case the reference source is not used. The sound power of an unknown source is determined based upon a measurement of the average sound pressure in the room with the source operating and a measurement of the reverberation time of the room. Both the direct and comparative techniques are permitted by the two standards noted above and both are easily performed in the room of the present invention. The comparative technique is more widely used.

It is within the scope and spirit of this invention to make such variations and substitution of equivalents as are apparent to a person of ordinary skill in the art.

Having thus described my invention, what I claim and desire to protect by letters patent is:

1. A substantially rigid reverberation room suitable for acoustic testing comprising:

a floor, a ceiling parallel thereto, said floor and said ceiling having substantially identical nonrectangular shape, said floor and said ceiling being connected by first, second, third and fourth interconnecting walls, said first and second walls being positioned at an angle of about 90 degrees to each other, said second and third walls being positioned at an angle of about 73 degrees forty-five minutes to each other; said third and fourth walls being positioned at an angle of about 125 degrees fifty minutes to each other, said first and fourth walls being positioned at an angle of about seventy degrees twenty-five minutes to each other;

said room having a volume of about 200 $m^3$;

the interior of said room being finished to possess a smooth, sealed surface to provide a minimum of acoustic absorption;

a first loudspeaker positioned at the intersection of said first and second walls and located substantially near said floor;

a second loudspeaker positioned at the intersection of said second and third walls and located substantially near said floor;

a third loudspeaker positioned at the intersection of said first and fourth walls and located in close proximity to said ceiling;

a microphone fixed to suitable supporting means which are positioned substantially in the central area of said floor and being at least one meter from any adjacent said wall;

an opening forming a transmission loss window located in said fourth wall which subtends the 90° angle formed by said first and second walls, said window in said fourth wall suitable for receiving samples to test said samples placed in a vertical position for transmission loss and providing unencumbered flow between said room and the exterior of the room;

an opening forming a transmission loss window located in said ceiling suitable for receiving samples to test said samples placed in a horizontal position for transmission loss, measurement of sound absorption or measurement of sound power, said window in said ceiling providing unencumbered flow between said room and the exterior of said room.

2. The reverberation room defined in claim 1 which has an anechoic chamber positioned immediately adjacent to said transmission loss window positioned in said fourth wall.

3. The reverberation room defined in claim 2 in which said transmission loss window positioned in said fourth wall opening measures 5 feet by 8 feet and provides an unencumbered path between said room and said anechoic chamber.

4. The reverberation room defined in claim 2 in which said chamber is rotatably secured by pivot means to an exterior wall of said room.

5. The reverberation room defined in claim 4 in which said chamber possesses walls, ceiling and floor all lined with anechoic wedges, said wedges adjacent said wall diametrically opposite said transmission loss window, opening into said chamber being 3 feet deep and said wedges lining other said walls, said floor and said ceiling being one foot deep.

6. The reverberation room defined in claim 2 in which said chamber possesses walls, ceiling and floor formed of a laminate structure comprising an exterior wall made of building facade material, an interior wall comprising two layers each about one inch thick of resilient foam, sandwiching a thermoplastic resin therebetween, a layer of 20 gauge steel, and anechoic wedges of open cell flexible foam capable of absorbing 99% of incident energy.

7. The reverberation room defined in claim 6 in which said resilient foam is polyurethane foam, said thermoplastic resin is polyvinylchloride, and said open cell foam is polyurethane.

8. The reverberation room defined in claim 1 which has an anechoic chamber positioned immediately adjacent to said transmission loss window positioned in said ceiling.

9. The reverberation room defined in claim 8 in which said transmission loss window positioned in said ceiling opening measures 2.5 feet by 2.5 feet and provides an unencumbered path between said room and said anechoic chamber.

10. The reverberation room defined in claim 8 in which said chamber possesses walls, ceiling and floor all lined with anechoic wedges, said wedges adjacent said ceiling diametrically opposite said transmission loss ceiling window, opening into said chamber being 3 feet deep and said wedges lining said walls and said floor being one foot deep.

11. The reverberation room defined in claim 8 in which said chamber possesses walls, ceiling and floor formed of a laminate structure comprising an exterior wall made of building facade material, an interior wall comprising two layers each about one inch thick of resilient foam, sandwiching a thermoplastic resin therebetween, a layer of 20 gauge steel, and anechoic wedges of open cell flexible foam capable of absorbing 99% of incident energy.

12. The reverberation room defined in claim 11 in which said resilient foam is polyurethane foam, said thermoplastic resin is polyvinylchloride, and said open cell foam is polyurethane.

13. The reverberation room defined in claim 1 which has an observation window in one of said walls and a door to enter the interior of said room.

14. The reverberation room defined in claim 1 which has a foundation positioned below ground level where it is installed.

15. The reverberation room defined in claim 14 which is located in a building and in which said foundation of said room is independent of the foundation of said building.

16. The reverberation room defined in claim 15 in which said foundation forming the floor of said room comprises poured concrete having a thickness of at least nine inches on a rigid foam layer having a thickness of at least 4 inches and over at least six inches of compacted sand.

17. The reverberation room defined in claim 1 in which of said room has exterior walls which are concrete block filled with mortar.

18. The reverberation room defined in claim 1 in which the interior walls at the interior of said room are sealed to possess a smooth continuous surface.

19. The reverberation room defined in claim 18 in which said walls are sealed with alkyd resin or epoxy paint.

* * * * *

UNITED STATES PATENT AND TRADEMARK OFFICE

CERTIFICATE OF CORRECTION

PATENT NO. : 5,884,436

DATED : March 23, 1999

INVENTOR(S) : Gordon L. Ebbitt

It is certified that error appears in the above-identified patent and that said Letters Patent is hereby corrected as shown below:

| | |
|---|---|
| Column 1, line 18 after "ASTM" | delete "4" |
| Column 4, line 18, change "formns" | to --forms-- |
| Column 10, line 1, claim 17 | delete "of" |
| Column 10, line 5, claim 18 | delete "interior" |

Signed and Sealed this

Twelfth Day of October, 1999

*Attest:*

Q. TODD DICKINSON

*Attesting Officer*

*Acting Commissioner of Patents and Trademarks*